US007487733B2

(12) United States Patent
Weinberg et al.

(10) Patent No.: US 7,487,733 B2
(45) Date of Patent: Feb. 10, 2009

(54) NEEDLE FOR MACHINE STITCHING WITH A COMPOSITE THREAD

(75) Inventors: Amotz Weinberg, Tel Aviv (IL); Yair Eilam, P O Box 3804, Tel Mond 40600 (IL)

(73) Assignees: Shenkar College of Engineering and Design, Ramat Gan (IL); Yair Eilam, Tel Mond (IL)

( * ) Notice: Subject to any disclaimer, the term of this patent is extended or adjusted under 35 U.S.C. 154(b) by 166 days.

(21) Appl. No.: 11/189,093

(22) Filed: Jul. 26, 2005

(65) Prior Publication Data

US 2006/0112867 A1 Jun. 1, 2006

(30) Foreign Application Priority Data

Jul. 26, 2004 (IL) ..... 163209

(51) Int. Cl.
*D05B 85/02* (2006.01)
*D05B 87/00* (2006.01)

(52) U.S. Cl. ..... 112/223

(58) Field of Classification Search ..... 112/222, 112/223, 224, 302, 80, 16; 223/102–104; 163/1–5

See application file for complete search history.

(56) References Cited

U.S. PATENT DOCUMENTS

| | | | | | |
|---|---|---|---|---|---|
| 568,946 | A | * | 10/1896 | Hanna | 112/222 |
| 735,458 | A | * | 8/1903 | Bunnel et al. | 112/224 |
| 806,840 | A | * | 12/1905 | Richardson | 112/224 |
| 946,789 | A | * | 1/1910 | Smith | 112/222 |
| 2,441,171 | A | * | 5/1948 | Schulz | 112/222 |
| 3,834,599 | A | * | 9/1974 | Herr | 223/102 |
| 4,480,563 | A | * | 11/1984 | Beyer et al. | 112/222 |
| 5,392,725 | A | | 2/1995 | Takei et al. | |
| 5,515,798 | A | | 5/1996 | Cahuzac | |
| 5,829,373 | A | | 11/1998 | Baxter | |
| 6,318,280 | B1 | | 11/2001 | Vornholt | |
| 6,332,416 | B1 | | 12/2001 | Wohnhas et al. | |
| 6,332,417 | B1 | | 12/2001 | Vornholt | |

* cited by examiner

*Primary Examiner*—Ismael Izaguirre
(74) *Attorney, Agent, or Firm*—Pearl Cohen Zedek Latzer

(57) ABSTRACT

The invention relates to the joining of fabrics made of advanced fibers for making pre-forms for composite materials. The invention provides a sewing machine needle which can be used to join fabrics by stitching with a brittle thread.

Figure 3:
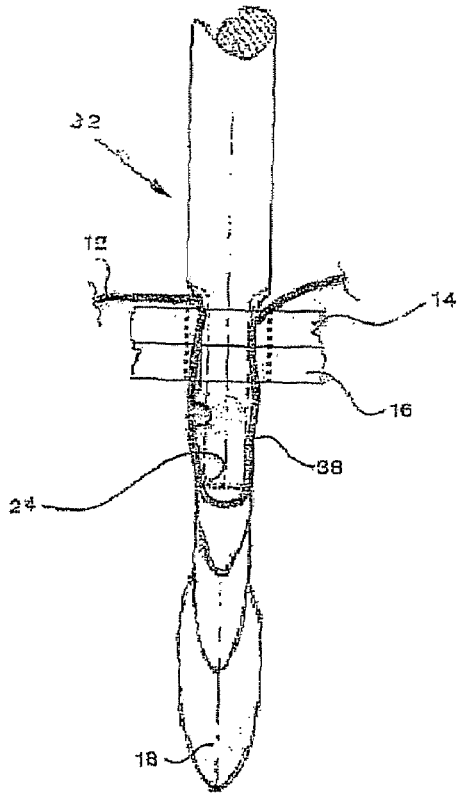

The needle, according to the invention, for stitching a brittle fiber thread through at least one layer of fibrous fabric, being characterized by the head (point) thereof having an (open eye) slit proximate to the needle point for receipt and release of the brittle thread, the slit of the needle having an arc shape with a radius of curvature of not less than 1 mm, to prevent sharp bending of the brittle thread when the thread is in contact with the slit.

7 Claims, 2 Drawing Sheets

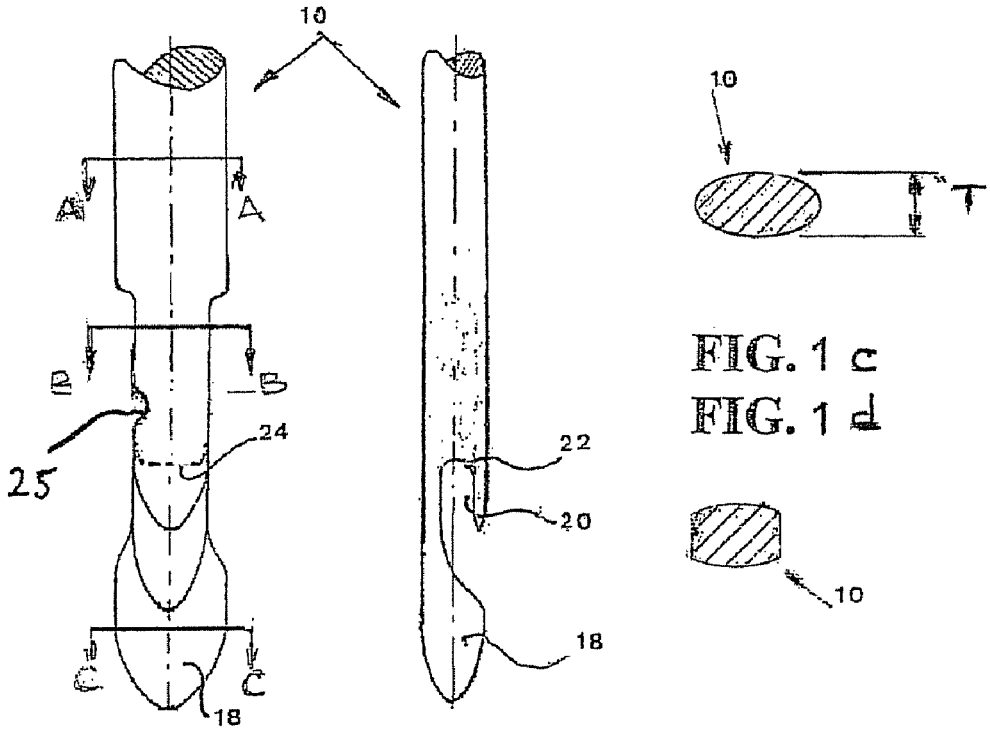
FIG. 1 a
FIG. 1 b
FIG. 1 c
FIG. 1 d
FIG. 2 b
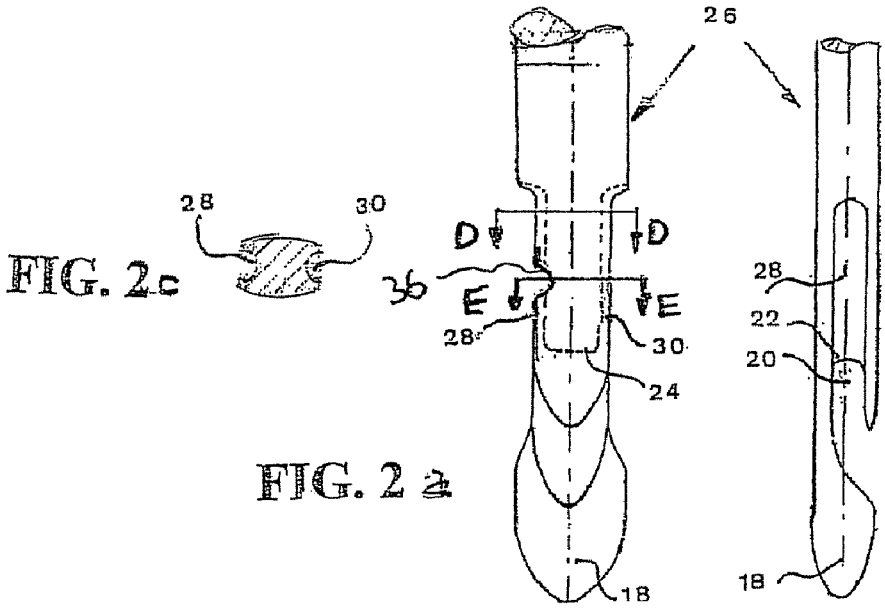
FIG. 2c
FIG. 2 a
FIG. 2 d
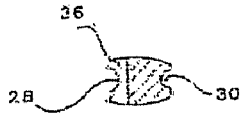

NEEDLE FOR MACHINE STITCHING WITH A COMPOSITE THREAD

CROSS REFERENCE TO RELATED APPLICATIONS

This application claims the benefit of IL application Serial No. 163209, filed on Jul. 26, 2004 which is incorporated in their entirety herein by reference.

FIELD AND BACKGROUND OF THE INVENTION

The present invention relates to the joining of fabrics made of advanced fibers for making pre-forms for composite materials.

More particularly, the invention provides a sewing machine needle which can be used to join fabrics by stitching with a brittle thread.

In the present specification, as in other prior documents, the terms "sewing thread" "brittle thread" "brittle fiber thread" "advanced fiber thread" "high performance threads" "technical fiber" are used interchangeably to designate a thread made from glass, ceramic, graphite or carbon fibers of a commercially or experimentally available type. No novelty is claimed here regarding the thread.

Composite fiber-reinforced materials are widely used wherever a high strength/weight ratio is needed, for example in aerospace vehicles and sports equipment. Glass and carbon fibers have long been used for reinforcing other materials, particularly plastics, in order to improve stiffness and tensile strength. The most popular method of manufacturing composite material is by laminating layers of advanced fibrous material and impregnating the layers with a resin. Such structure is vulnerable to delamination since the strength of the bonding between the layers is limited to the strength of the matrix. Ideally, the layers should be stitched together with the same fibrous material that they are made of in order to increase the interlayer strength and to prevent delamination of the material. Stitching with advanced fibrous yarn is difficult since such fibers are brittle and sensitive to sharp bending and friction.

Threads based on carbon or glass fibers are commercially available. It has however been found that when sharply bent or when friction is applied, such yarns tend to break. The standard sewing machines apply very sharp bends to the threads as well as friction with the sewing needle eye during the sewing process. Hence, they are inadequate for stitching with brittle yarns.

The key component of a stitching device is the sewing machine needle which pierces the fabrics being joined, carries a thread loop through the material, and retracts while leaving the loop protruding or hooked to the other side of the fabrics. The fabrics being joined are moved and the stitching procedure is repeated at an adjacent site. The loops can be engaged by a second lower thread, as is seen in common sewing machines, or other methods.

The state of the art can be assessed from a brief review of recent U.S. Patents.

Takei et al. show a machine needle in U.S. Pat. No. 5,392,725, claiming improved clearance between the blade of the needle and the thread. However the text refers mainly to needle manufacturing methods.

Cahuzac in U.S. Pat. No. 5,515,798 claims a stitching head and needle guide, the needle 33 seen is substantially of conventional design.

Baxter discloses a blind stitching apparatus featuring a curved needle as seen in U.S. Pat. No. 5,829,373. The stitches are placed at discrete-locations to join pre-forms to make a composite component.

A sewing machine needle having offset eye webs is claimed by Vornholt in U.S. Pat. No. 6,318,280. The needle eye is bordered by off-set spaced eye webs. In U.S. Pat. No. 6,332,417 the same inventor details a further needle having a slender eye.

A similar needle is disclosed by Wohnhas et al, in U.S. Pat. No. 6,332,416. Improved loop formation is claimed, due to a protuberance adjoining the eye outlet.

OBJECTS OF THE INVENTION

It is therefore one of the objects of the present invention to obviate the disadvantages of prior art machine needles and to provide a needle which can be used with brittle threads. Typically thread diameter will be in the 0.2-2 mm range.

A further object of the present invention is to provide a needle which releases and recaptures the sewing thread during each stitching action, allowing unrestricted entry of another, non-brittle lower thread to secure the loops of said brittle thread.

SUMMARY OF THE INVENTION

The present invention achieves the above objects by providing a sewing machine needle for stitching a brittle fiber thread through at least one layer of fibrous fabric, said needle being characterized by the head (point) thereof having an (open eye) slit proximate to the needle point for receipt and release of said brittle thread, said slit having an arc shape with a radius of curvature of not less than 1 mm, to prevent sharp bending of said brittle thread when said thread is in contact with said slit.

In a preferred embodiment said needle that at least the head thereof being of non circular shape. In a further preferred embodiment of the present invention there is provided a sewing machine needle further provided with a pair of spaced-apart thread guide grooves, the major portion of said grooves being disposed parallel to the needle axis.

In a most preferred embodiment of the present invention a sewing machine needle has a side indentation along a horizontal axis when said needle is held on a vertical axis said recess being located at a height to be accessible from the underside of said fabric when said needle is in use and has reached its lowest position.

It will thus be realized that the novel needle of the present invention serves to capture the thread, pierce the fibrous material, retract after loop making, release the thread and repeat at the next station. Preferably the needle is used in combination with the sewing machine disclosed in our co-pending application.

Stitching as described in the present text is executed while the fabric(s) being stitched are still pliable. After stitching, the fabric article is usually impregnated with resin and cured at room temperature or in an oven. Pre-impregnated layers of fibrous materials with resin may also be used for producing composite materials and it may be necessary to stitch several layers of them before the resin is cured. The novel needle of the present invention may also serve for stitching pre-impregnated layers of fibrous materials.

SHORT DESCRIPTION OF THE DRAWINGS

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

Figure 4:
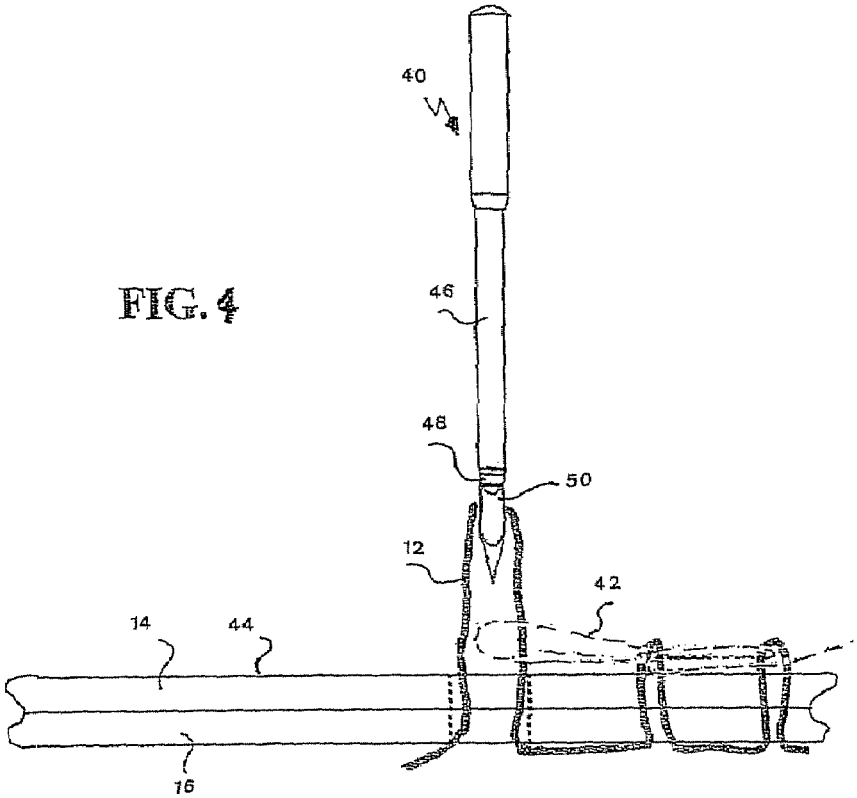

In the drawings:

FIG. 1*a* is an elevational view of a preferred embodiment of the needle according to the invention;

FIG. 1*b* is a side view of the same embodiment;

FIG. 1*c* is a cross-sectional view taken at AA and at CC;

FIG. 1*d* is a cross-sectional view taken at BB;

FIG. 2*a* is an elevational view of an embodiment having thread guide grooves;

FIG. 2*b* is a side view of the same embodiment;

FIG. 2*c* is a cross-sectional view taken at DD;

FIG. 2*d* is a cross-sectional view taken at EE;

FIG. 3 is an elevational view of an embodiment with fabrics showing a brittle thread engaged in the needle eye; and FIG. 4 is a side view of an embodiment of the needle used for the brittle thread for stitching with the second non-brittle, thread disposed on the upper surface of the fibrous fabrics.

FULL DESCRIPTION OF THE INVENTION

There is seen in FIGS. 1*a, b, c, d*, a sewing machine needle 10 for stitching a brittle thread 12, seen in FIG. 3, through two layers 14, 16 of a fibrous fabric, also seen in FIG. 3.

The needle 10 is characterized by the head or penetrating point 18 thereof being preferably of non-circular shape and having an open eye 20 proximate to the point 18 for receipt and release of the brittle thread.

The edges 24 of closed extremity groove 22 of the open eye 20 are rounded to prevent sharp bending of the brittle thread when the thread is in contact with the groove 22.

The thickness "T" of the non-circular section of the needle is between 1.5 to 2.5 times as large as the diameter of the brittle fiber thread 12 to be used.

For example, assume that the diameter of the thread 12 is 1 mm. Needle thickness "T" is about 2 mm and width is about 4 mm, as is seen in the enlarged drawing in FIG. 1*c*.

There is a danger of breakage if the thread is bent around an object of radius 2 mm or less. To prevent such thread rupture the curve 24 is rounded.

The needle 10 is provided with a side indentation 25 disposed along a horizontal axis when the needle is held on a vertical axis as seen in the figure. The recess 25 is located at a height to be accessible from the underside of the lower fabric when the needle 10 is in use and has reached its lowest position as seen in FIG.3.

The indentation 25 provides clearance for a second needle (not seen) to insert a loop of a second, thread (not seen) through the loop 38 seen in FIG. 3 formed by the brittle fiber thread 12 when the needle 34 is in operation.

With reference to the rest of the figures, similar reference numerals have been used to identify similar parts of the needle.

Referring now to FIGS. 2*a,b,c,d*, there is seen a sewing machine needle 26 again of substantially oval cross-section. In the shown embodiment the width of the non-circular section of the needle 26 is twice as large as its thickness. The width-to-thickness ratio chosen depends upon the structure of the brittle thread and the fabric being used. The ratio can vary from between 1:1 to 5:1.

The needle 26 is further provided with a pair of spaced-apart thread guide channels 28, 30, the major portion of the channels 28, 30 being disposed parallel to the needle axis. The width of the channels 28, 30 is substantially equal to the thread diameter. The length of each guide channel 28, 30 exceeds the thickness of the advanced fiber fabric(s) to be stitched.

The needle 26 is provided with a side indentation 36 disposed along a horizontal axis when the needle is held on a vertical axis as seen in the figure. The recess 36 is located at a height to be accessible from the underside of the lower fabric when the needle 26 is in use and has reached its lowest position as seen in FIG. 3.

The indentation 36 provides clearance for a second needle (not seen) to insert a loop of a second thread (not seen) through the loop 38 seen in FIG. 3 formed by the brittle fiber thread 12 when the needle 34 is in operation.

Seen in FIG. 3 is a sewing machine needle 32 which is dimensioned to stitch together two layers of fabric 14, 16 of an advanced fiber fabric of total thickness up to about 20 mm.

The thread 12 is seen in contact with the edges 24 of closed extremity 22, seen in FIG. 1*b*, a loop 38 having been formed by downward movement of the needle 32.

FIG. 4 shows an embodiment of the needle 40 used for the brittle thread 12 for executing stitching in a manner where the second thread 42 is disposed on the upper surface 44 of the advanced fiber fabric(s) 14, 16 to be stitched.

The needle 40 has an extended narrow stem 46. The opening leading 48 leading to the needle eye 50 is located in the lower quarter of the stem length. Curved surfaces of the groove 50 prevent sharp bending of the brittle thread 12 as the needle 40 collects and draws the brittle thread 12 from below the lower surface of the fabric 16 to be stitched and draws the thread 12 to a level substantially above the upper surface of the fabric 14.

The scope of the described invention is intended to include all embodiments coming within the meaning of the following claims. The foregoing examples illustrate useful forms of the invention, but are not to be considered as limiting its scope, as those skilled in the art will be aware that additional variants and modifications of the invention can readily be formulated without departing from the meaning of the following claims.

We claim:

1. A sewing machine needle for stitching a brittle thread through at least one layer of a material, said needle being characterized by having an open eye proximate to the needle point for release and recapture of said brittle thread during each stitching action, the closed extremity of said open eye being rounded to prevent sharp bending of said brittle thread when said thread is in contact with said closed extremity, wherein a head of said needle has a non-circular cross section, the width of said non-circular cross section is between 1.1 to 5 times as large as its thickness.

2. The sewing machine needle as claimed in claim 1, further provided with a pair of spaced-apart thread guide channels, the major portion of said channels being disposed parallel to the needle axis.

3. The sewing machine needle as claimed in claim 2, wherein the length of each of said guide channels exceeds the thickness of the material to be stitched by said needle.

4. The sewing machine needle as claimed in claim 1, wherein said needle is dimensioned to stitch at least one layer of a material of total thickness up to about 20 mm.

5. The sewing machine needle as claimed in claim 1, wherein said material is one of a list comprising fibrous fabric, leather, plastic, metal or combination thereof.

6. The sewing machine needle as claimed in claim 1, being provided with a side indentation along a horizontal axis when said needle is held on a vertical axis, said indentation being located at a height to be accessible from the underside of said material when said needle is in its lowest position.

7. The sewing machine needle as claimed in claim 1 configured for use in a stitching machine wherein a second thread is disposed on the upper surface of advanced fiber fabric(s) to be stitched, said needle being provided with an extended narrow stem, the opening leading to the needle eye being located in the lower quarter of the stem length, curved surfaces of said needle eye preventing sharp bending of said brittle fiber thread as said needle collects and draws said brittle fiber thread from below the lower surface of said advanced fiber fabric(s) to be stitched and draws said thread to a level substantially above the upper surface of said fabric(s).

* * * * *